United States Patent [19]

Shea

[11] Patent Number: 4,527,289

[45] Date of Patent: Jul. 9, 1985

[54] BRACE INCORPORATING PULLEY MECHANISM

[76] Inventor: Lance L. Shea, 2933 N. 83rd St., Scottsdale, Ariz. 85251

[21] Appl. No.: 369,536

[22] Filed: Apr. 19, 1982

Related U.S. Application Data

[63] Continuation-in-part of Ser. No. 189,070, Sep. 22, 1980.

[51] Int. Cl.[3] ..... A41F 3/00; A61F 5/04

[52] U.S. Cl. ..... 2/322; 128/85; 128/90

[58] Field of Search ..... 2/322, 321, 336, 338, 2/340, 311, 312, 237, 221, 16, 22; 24/163 R, 312; 128/85, 87 R, 87 A, 89 R, 90

[56] References Cited

U.S. PATENT DOCUMENTS

| | | | |
|---|---|---|---|
| 1,137,499 | 4/1915 | Lieberman | 2/237 |
| 1,601,173 | 9/1926 | Hill | 2/338 X |
| 2,281,086 | 4/1942 | Blankenhorn | 2/237 |
| 3,014,256 | 12/1961 | Derrickson et al. | 24/163 R X |
| 3,112,496 | 12/1963 | Dritz | 2/338 X |
| 3,591,866 | 7/1971 | Jensen | 24/312 X |
| 3,719,187 | 3/1973 | Ulansen | 128/87 R |
| 3,777,315 | 12/1973 | Norfolk | 2/321 |
| 4,273,130 | 6/1981 | Simpson | 2/338 X |

FOREIGN PATENT DOCUMENTS

| | | | |
|---|---|---|---|
| 505424 | 5/1939 | United Kingdom | 2/237 |

*Primary Examiner*—H. Hampton Hunter

*Attorney, Agent, or Firm*—Cahill, Sutton & Thomas

[57] ABSTRACT

A brace for supporting or immobilizing a portion of the human body. The brace may take the form of a waist belt for weight lifting incorporating a pulley arrangement for tightening the belt. The waist belt includes a heavy leather belt having first and second ends. First and second rectangular metal loops are secured proximate the first and second ends, respectively, of the leather belt, each of the rectangular metal loops including a cylindrical roller rotatably mounted thereto. A nylon strap is secured at a fixed end to the leather belt proximate the second end thereof, and the free end of the strap is wound over the rollers of the first and second metal loops to form a pulley arrangement for drawing the ends of the leather belt together. First and second complementary fastening surfaces are secured to the free end of the strap and to the leather belt, respectively, for removably attaching the free end of the strap to the leather belt after the belt has been sufficiently tightened. Alternatively, the brace may take the form of a joint immobilizer having a pulley arrangement for tightening the immobilizer and prevent articulation of the joint.

5 Claims, 6 Drawing Figures

BRACE INCORPORATING PULLEY MECHANISM

CROSS-REFERENCE TO RELATED APPLICATION

This application is a continuation-in-part of co-pending application Ser. No. 189,070, filed Sept. 22, 1980 entitled "WEIGHT LIFTER'S BELT INCORPORATING PULLEY MECHANISM", now U.S. Pat. No. 4,509,214.

BACKGROUND OF THE INVENTION

1. Field of the Invention

The present invention relates generally to braces, and more particularly, to braces for supporting or immobilizing a portion of the human body and incorporating a pulley mechanism for tightening the brace.

2. Description of the Prior Art

In the sport of weight lifting, participants frequently wear a body support or brace that takes the form of a waist belt to properly support their bodies in order to prevent injury thereto. Conventional weight lifting belts are made of heavy leather and include a plurality of tongues at one end of the belt for engaging a corresponding plurality of buckles attached to the opposite end of the belt. Typically, such weight lifting belts are approximately four inches wide and one-quarter inch thick, the permissible range of width and thickness being specified by international sport federations.

Weight lifting belts must be secured very tightly in order for the wearer to obtain proper support therefrom. However, it is very difficult for the wearer to sufficiently tighten the belt by himself. Accordingly, it is not unusual for two other persons to pull the ends of the belt together in order to sufficiently tighten the belt for proper support while the wearer engages the buckles. Similarly, it is very difficult for the wearer to remove the tightened belt by himself, and the help of another person is frequently required to unbuckle the belt.

Tremendous tensional forces are applied to a weight lifting belt when the wearer is lifting weights, particularly in the case of heavyweight classes of competition. These tensional forces are transmitted directly to the tongues and buckles of conventional weight lifting belts and apply significant stresses thereto.

The same considerations are involved when the brace takes the form of an immobilizer. For example, an injured person may require a brace to prevent articulation of an elbow. The application of sufficient force to tighten the brace renders self mounting of the brace difficult or even impossible since the injured person must operate with only one hand.

Accordingly, it is an object of the present invention to provide a brace for supporting or immobilizing a portion of the human body which can be sufficiently tightened and fastened by the wearer alone in order to provide himself with proper support, and which brace can be easily removed by the wearer alone.

It is a further object of the present invention to provide a brace for supporting or immobilizing a portion of the human body which evenly distributes tensional forces at a plurality of points disposed along the brace.

These and other objects of the present invention will become apparent to those skilled in the art as the description thereof proceeds.

SUMMARY OF THE INVENTION

Briefly described and in accordance with one embodiment thereof, the present invention relates to a waist belt for weight lifting wherein the waist belt incorporates a pulley arrangement for tightening the belt. The waist belt includes a belt having first and second ends. First and second strap engaging members are secured to the belt proximate the first and second ends thereof. A flexible strap has a fixed end secured to the belt proximate the second end thereof and also has a free end opposite the fixed end. The free end of the flexible strap is wound over the first strap engaging member and is then wound over the second strap engaging member for forming a pulley arrangement in order to tighten the belt when the free end of the strap is pulled.

Preferably, the first and second strap engaging members each include a roller for rotatably engaging the flexible strap. First and second complementary fastening surfaces are secured to the free end of the flexible strap and to the belt, respectively, for removably attaching the free end of the strap to the belt after the belt has been sufficiently tightened.

In the preferred embodiment of the invention, the waist belt includes an additional flexible strap having a tension-bearing end secured to the belt, and the second fastening surface is attached to the additional flexible strap. The flexible strap and the additional flexible strap are removably secured to the belt for allowing the first and second fastening surfaces to be conveniently replaced periodically.

Preferably, the fixed end of the flexible strap and the second strap engaging member are secured to the belt at points spaced apart from one another to distribute tensional forces along the belt. Similarly, the tension-bearing end of the additional flexible strap is secured to the belt at a point spaced apart from the points at which the first and second strap engaging members are secured to the belt to further distribute tensional forces along the belt.

DETAILED DESCRIPTION OF THE PREFERRED EMBODIMENTS

Figure 1:
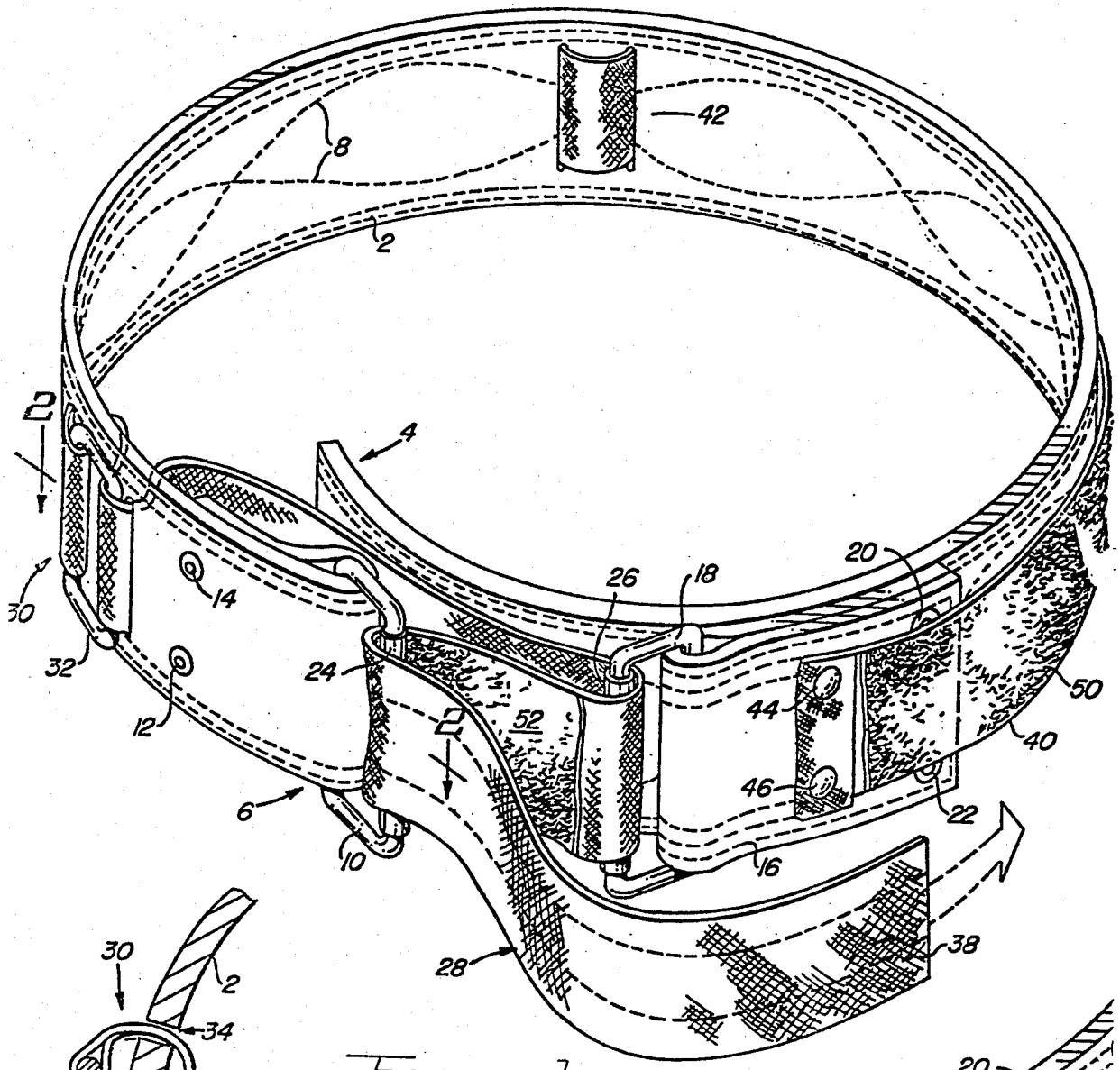
FIG. 1 is a perspective view of a weight lifting belt incorporating a pulley arrangement according to the teachings of the present invention.

FIG. 1 illustrates a waist belt for weight lifting which includes a heavy leather belt 2 having a first end generally designated 4 and a second end generally designated 6. Leather belt 2 is approximately four inches wide and approximately one-quarter inch in thickness and may be formed of two or more layers of leather sewn together by stitching 8 as shown in FIG. 1.

Figure 2:
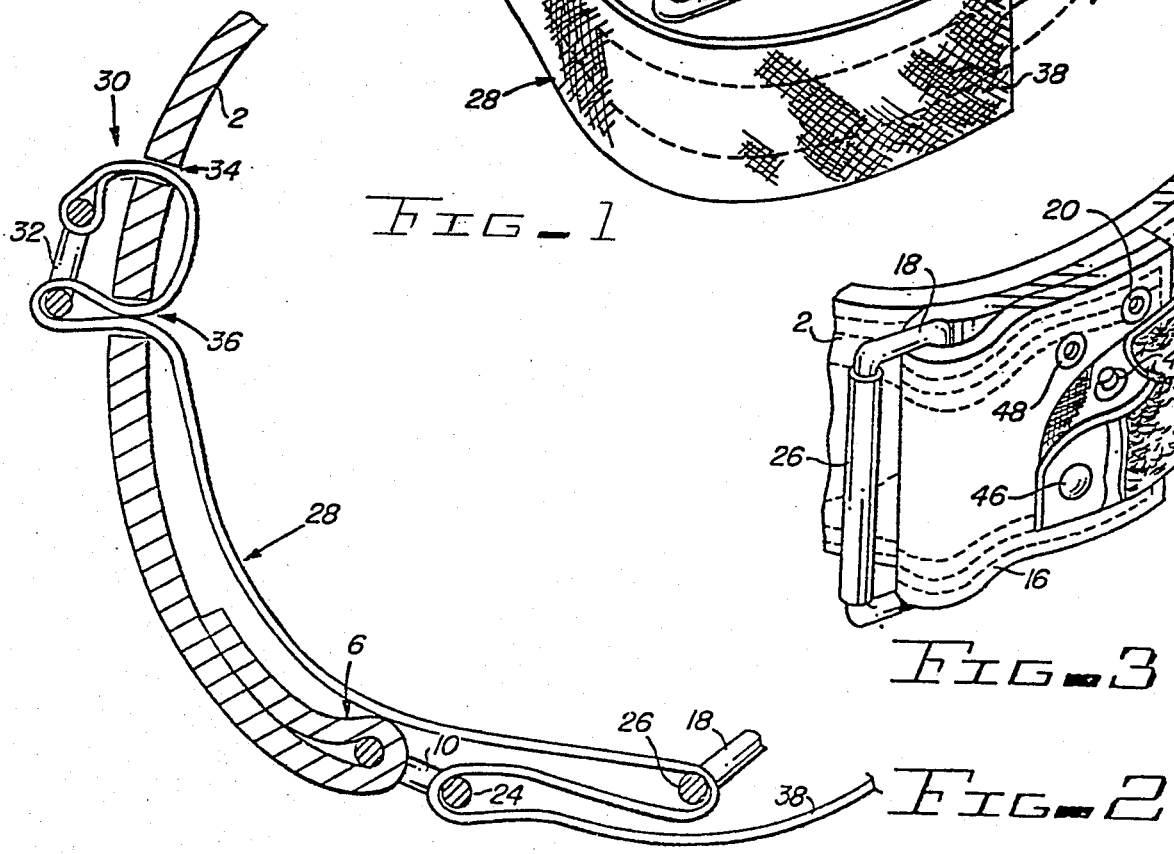
FIG. 2 is a cross-sectional view taken through lines 2—2 shown in FIG. 1 and illustrating the manner in which a flexible strap is wound over rollers secured proximate opposite ends of the belt to form the pulley arrangement.
Figure 3:
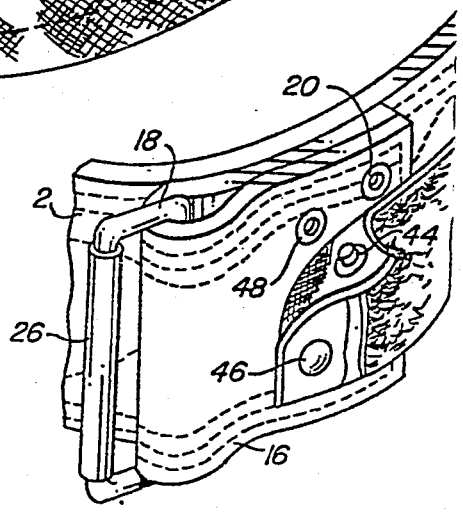
FIG. 3 is a partial view showing the connection between the additional flexible strap and the leather piece.

As shown in FIGS. 1 and 2, second end 6 of leather belt 2 passes through a rectangular metal loop 10 and is overlapped upon itself. Rivets 12 and 14 secure the overlapped portions of second end 6 together. As shown in FIGS. 1 and 3, a piece of heavy leather 16 passes through a rectangular metal loop 18 and is overlapped upon itself. The overlapped portions of leather piece 16 are secured to each other and to leather belt 2 proximate first end 4 by rivets 20 and 22. Preferably, first end 4 of belt 2 extends approximately six to twelve inches beyond rectangular metal loop 18 for allowing ends 4 and 6 of belt 2 to overlap one another even if the wearer has a relatively large physique. As shown in FIGS. 1–3, cylindrical rollers 24 and 26 are rotatably secured to rectangular metal loops 10 and 18, respectively.

Referring now to FIGS. 1 and 2, a flexible strap 28, preferably made of nylon, is provided to form a pulley mechanism in conjunction with rollers 24 and 26 for tightening belt 2. Strap 28 has a fixed end, designated generally by reference numeral 30, which passes through a rectangular metal loop 32 and overlaps itself, the overlapped portions being secured to one another as by stitching. As shown best in FIG. 2, belt 2 has a pair of slots 34 and 36 formed therein proximate second end 6. The free end 38 of strap 28 opposite fixed end 30 is inserted through slot 34 from the outer face of belt 2 and is inserted through slot 36 from the inner face of belt 2. After exiting slot 36, free end 38 extends through and around rectangular metal loop 32 and is inserted back through slot 36 from the outer face of belt 2 for removably securing fixed end 30 of strap 28 to belt 2.

When the wearer puts belt 2 around his waist, free end 38 of strap 28 is advanced toward loop 18. Free end 38 is then passed under roller 26, through rectangular metal loop 18, and around roller 26 for allowing roller 26 to rotatably engage strap 28 at a first point disposed between fixed end 30 and free end 38. Free end 38 is then passed under roller 24, through rectangular metal loop 10, and around roller 24 for allowing roller 24 to rotatably engage strap 28 at a second point disposed between the first point and free end 38. In order to tighten belt 2, free end 38 is pulled in the direction indicated by the dashed arrow within FIG. 1. The pulley arrangement formed by rollers 24 and 26 and strap 28 effectively multiplies the pulling force applied at free end 38 of strap 28 for tightening belt 2.

Referring now to FIGS. 1 and 3, an additional flexible strap 40, preferably made of nylon, has a tension-bearing end, designated generally by reference numeral 42, secured to the rear portion of belt 42 approximately intermediate first end and second end 6. Tension-bearing end 42 of additional strap 40 is secured to belt 2 in a similar manner to that used to secure fixed end 30 of strap 28 to belt 2. The end of additional strap 40 opposite tension-bearing end 42 is provided with snap-type fasteners 44 and 46. A complementary snap-type fastener 48 is attached to leather piece 16 opposite fastener for engagement therewith. Similarly, a second complementary 44 snap-type fastener (not shown) is attached to leather piece 16 opposite fastener 46 for engagement therewith.

Stitched to the outward side of additional strap 40 is a fastening surface 50, and stitched to strap 28 along the inwardly facing surface thereof is a complementary fastening surface 52. Fastening surfaces 50 and 52 may be of the type commercially available from American Velcro, Inc. under the registered trademark "VELCRO"; one of the fastening surfaces 50 and 52 comprises an all-nylon tape covered with finely woven monofilaments formed into permanent hooks, while the other of such fastening surfaces is an all-nylon tape covered with soft nylon loops. Such fastening surfaces removably engage and adhere to one another when pressed together.

After the wearer of the belt has pulled free end 38 of strap 28 to sufficiently tighten belt 2, free end 38 of strap 28 is pressed against additional strap 40 for contacting fastening surface 52 against fastening surface 50. The tension thereby transmitted from free end 38 of strap 28 to additional strap 48 is, in turn, transmitted to belt 2 at tension-bearing end 42. When it is desired to remove the belt, the wearer merely lifts free end 38 of strap 28 away from additional strap 40 for disengaging fastening surfaces 50 and 52; the wearer than unthreads strap 28 from rectangular metal loops 10 and 18 in order to remove belt 2.

Those skilled in the art will appreciate that the pulley arrangement formed by strap 28 and rollers 24 and 26 allows the wearer of the belt to sufficiently tighten and fasten the belt without the aid of other persons. It will also be appreciated that additional rollers may be secured to belt 2 and that strap 28 may be wound around these additional rollers for further multiplying the force applied to free end 38 of strap 28 in order to tighten belt 2. It will also be noted that the inner diameter of belt 2 can be adjusted to accommodate weight lifters having widely different physiques. Strap 28 and fastening surface 52 attached thereto are sufficiently long to allow strap 28 to overlap additional strap 40 and to allow fastening surfaces 50 and 52 to contact one another when the belt is tightened, regardless of the physique of the particular wearer.

Those skilled in the art will also appreciate that a belt constructed according to the teachings of the present invention more uniformly distributes tensional forces across the length of the belt than in the prior art. Fixed end 30 of flexible strap 28 and rectangular metal loop 10 are secured to belt 2 at points spaced apart from one another for distributing tensional forces applied to second end 6 of belt 2. Similarly, tension-bearing end 42 of additional strap 40 and rectangular metal loop 18 are secured to belt 2 at points spaced apart from one another for distributing tensional forces applied to first end 4 of belt 2.

It will also be noted that strap 28 and additional strap 40 are easily removable from belt 2 for allowing convenient replacement thereof. Periodic replacement of strap 28 and additional strap 40 may be desirable in order to provide fresh fastening surfaces 50 and 52 for use in conjunction with belt 2. The manner in which fixed end 30 of strap 28 and first end 42 of additional strap 40 are anchored to belt 2 allows strap 28 and additional strap 40 to transmit tensional forces to belt 2 while allowing strap 28 and additional strap 40 to be easily removable from belt 2.

Figure 4:
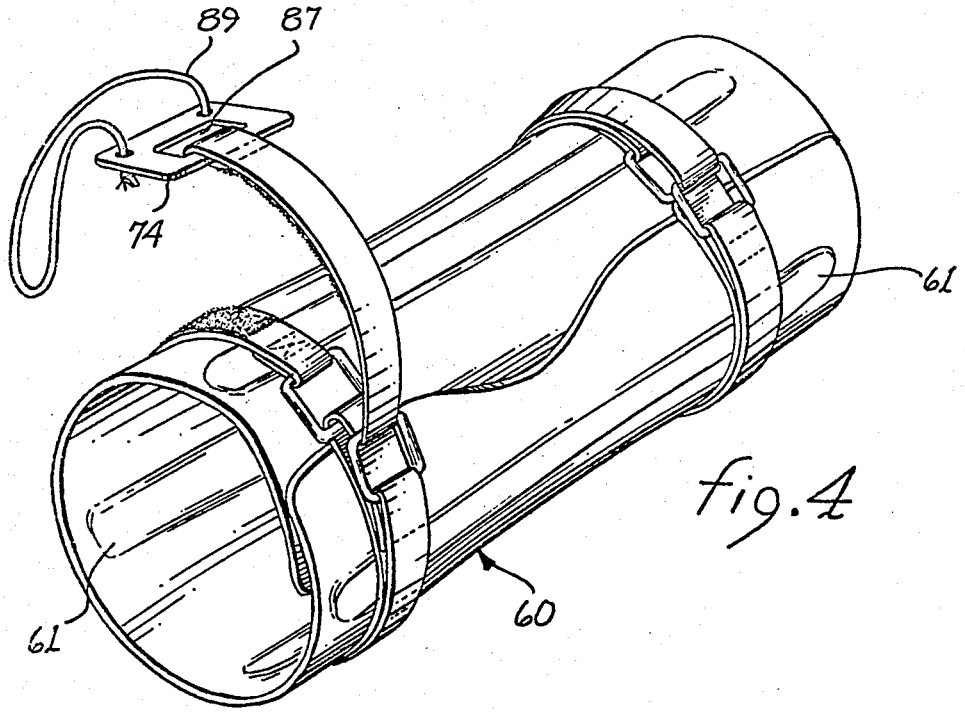
FIG. 4 is a perspective view of a brace in the form of a joint immobilizer incorporating a pulley arrangement according to the teachings of the present invention.
Figure 5:
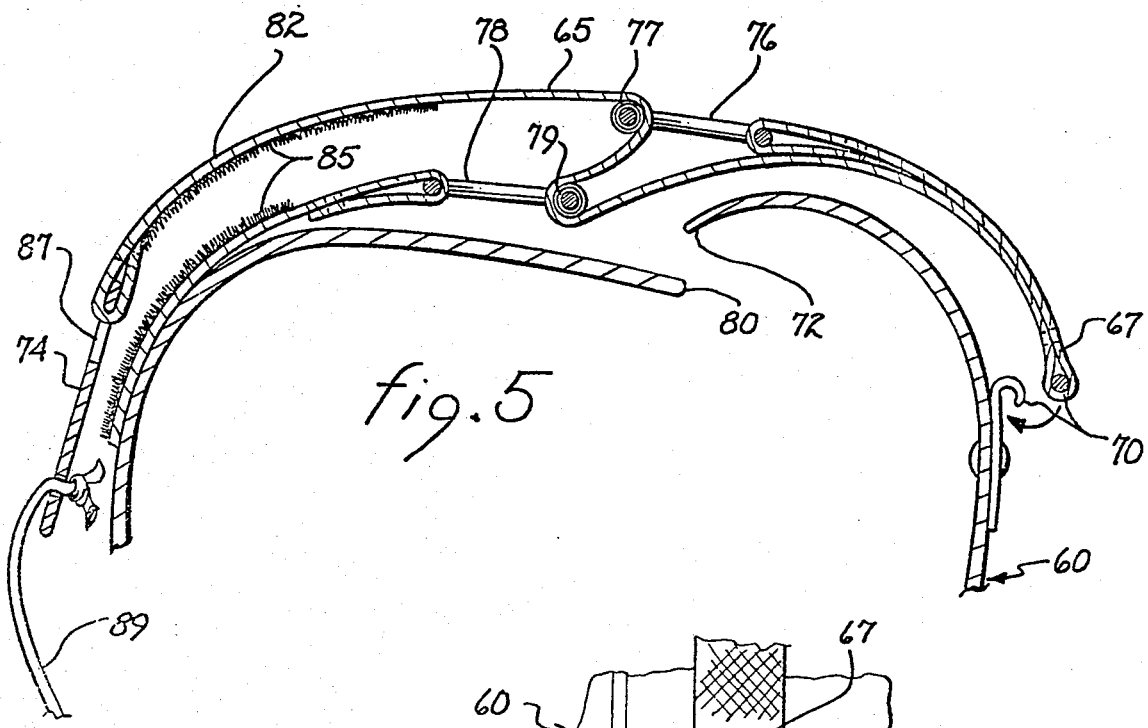
FIG. 5 is a cross-sectional view of a portion of FIG. 4.
Figure 6:
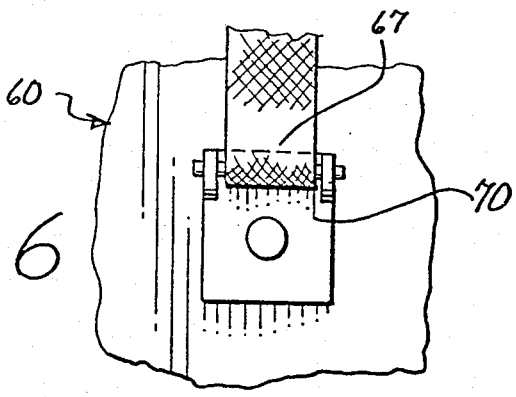
FIG. 6 is a plan view of a securing means used on the embodiment of FIGS. 4 and 5.

Referring now to FIGS. 4, 5 and 6, another embodiment of the present invention is shown. A brace 60 is shown in the form of an elbow immobilizer. The brace may be formed from layers of soft flexible material incorporating longitudinally extending stiffeners such as those shown at 61 to prevent longitudinal bending of the brace when it is in place. The material and longitudinally extending stiffeners form a wrap that may be placed around the joint to be immobilized. The wrap must then be tightened around the joint to perform its immobilizing function.

A flexible strap 65 is provided with a first end 67 detachably secured to said wrap through the utilization of a catch or buckle arrangement 70. The attachment of the flexible strap is proximate one end 72 of the wrap 60. The other end of the flexible strap 65 is free and may incorporate a device such as that shown at 74 that performs several functions as will be described more fully hereinafter. A loop 76 of rigid material such as metal is also attached to the wrap 72 through the expediency of the catch or buckle arrangement 70 and is provided with a roller 77 in contact with the flexible strap 65. Similarly, a second loop 78 of rigid material such as metal is provided with a roller 79 also in contact with the flexible strap 65. The loop is attached to the wrap 60 by any convenient means such as sewing at a position proximate the end 80 of the wrap. It may be seen by reference to FIG. 5 that the flexible strap 65 forms a pulley arrangement passing over the rollers 77 and 79 such that a force multiplication is exerted upon the wrap 60 causing the ends 72 and 80 thereof to overlap and forcing the wrap into intimate contact with the limb or joint upon which the brace is mounted. The free end 82 of the flexible strap 65 may be secured, after the brace has been placed on the limb and the strap tightened, through any simple expedient such as the utilization of commercially available VELCRO ® surfaces 85.

The device 74 facilitates the grasping of the end of the flexible strap in those instances where the brace is being placed on the body (e.g., an elbow) and the operation of mounting the brace must be performed by the wearer with one hand. It may also be noted that the device 74 is of such a size that it will not fit through the loops 76 or 78; therefore, the free end 82 of the flexible strap 65 can not be "unthreaded" through the loops. If the free end did become unthreaded, it would be difficult, if not impossible, for the wearer to thread the flexible strap while maintaining the brace in a proper position without the assistance of a second hand. Device 74 also includes an opening 87 therein as well as a thong 89 attached thereto. The opening 87 and thong 89 may conveniently be used to temporarily "hook" the free end of the strap on an object to assist the wearer in tightening the brace.

It may also be noted that the end 67 of the flexible strap 65, as well as the loop 76 are attached to the wrap 60 through the use of a detachable connection or catch or buckle arrangement 70. Since the flexible strap 65 may not be unthreaded through the loops 76 and 78, the wrap 60 would not be able to be opened flat and subsequently be placed around the joint unless some provision were made to disconnect the strap, thus permitting the ends 72 and 80 of the wrap 60 to be separated for the admission of the limb.

In operation, the free end 82 of the flexible strap is disconnected by breaking the VELCRO ® connection, and the other end of the flexible strap is disconnected from the wrap by disengaging the catch or buckle arrangement 70. The wrap is then opened and subsequently placed around the joint, such as the elbow, and the brace tightened by means of the pulley arrangement. That is, the catch or buckle arrangement 70 is used to connect the flexible strap 65 to the wrap while the free end 82 of the flexible strap is pulled (perhaps through the expediency of placing the thong over a stationary object and pulling) until the ends 72 and 80 of the wrap overlap and the wrap is forced into firm and intimate contact with the limb. The free end 82 of the flexible strap is then fixed in its tightened position through the employment of the VELCRO ® fastening. The entire operation can be performed with one hand and without the help of others.

While the invention has been described with reference to the preferred embodiments thereof, the description is for ullustrative purposes only and is not to be construed as limiting the scope of the invention. Various modifications and changes may be made by those skilled in the art without departing from the true spirit and scope of the invention as defined by the appended claims.

I claim:

1. A brace for supporting or immobilizing a portion of the human body comprising:

a. a wrap, having first and second ends, for encompassing a portion of the body;

b. a flexible strap having a first end secured to said wrap proximate the second end thereof, said flexible strap having a free end opposite the fixed end;

c. first means secured to said wrap proximate the first end thereof for engaging said flexible strap at a first point disposed between the fixed end and free end thereof;

d. second means secured to said wrap proximate the second end thereof for engaging said flexible strap at a second point disposed between the first point and the free end thereof;

e. said flexible strap, said first means, and said second means forming a pulley arrangement for tightening said wrap when the free end of said flexible strap is pulled; and f. means to secure said wrap when tightened.

2. The combination set forth in claim 1 wherein said first and second means each include a rigid loop secured to said wrap for engaging said flexible strap.

3. The combination set forth in claim 2 wherein first and second means each include a roller mounted on said rigid loop for rotatably engaging said flexible strap.

4. The combination set forth in claims 1, 2 or 3 wherein the first end of said flexible strap is detachably secured to said wrap.

5. The combination set forth in claim 4 including a device attached to the free end of said flexible strap, said device being sized too large to pass through said rigid loop to thereby prevent the free end of said strap from passing through said loop.

* * * * *